United States Patent [19]

Jones

[11] 4,375,109

[45] Mar. 1, 1983

[54] PASSIVE DISPENSER HAVING A DOUBLE AIR VENT SYSTEM

[75] Inventor: Gregory R. Jones, Cincinnati, Ohio

[73] Assignee: The Drackett Company, Cincinnati, Ohio

[21] Appl. No.: 350,839

[22] Filed: Feb. 22, 1982

[51] Int. Cl.[3] ..... E03D 9/02

[52] U.S. Cl. ..... 4/228; 4/227; 222/424.5

[58] Field of Search ..... 4/222, 227, 228; 222/424.5, 416, 204, 57, 54

[56] References Cited

U.S. PATENT DOCUMENTS

| | | | |
|---|---|---|---|
| 650,161 | 5/1900 | Williams et al. . | |
| 969,729 | 9/1910 | Smith | 4/228 |
| 1,144,525 | 6/1915 | Blake . | |
| 1,175,032 | 3/1916 | Williams | 4/228 |
| 1,213,978 | 1/1917 | Thornton | 4/227 |
| 1,987,689 | 1/1935 | Lewis | 221/67 |
| 3,504,384 | 4/1970 | Radley et al. | 4/228 |
| 3,618,143 | 11/1971 | Hill et al. | 4/228 |
| 3,769,640 | 11/1973 | Castronovo | 4/228 |
| 3,778,849 | 12/1973 | Foley | 4/228 |
| 3,831,205 | 8/1974 | Foley | 4/228 |
| 3,943,582 | 3/1976 | Daeninckx et al. | 4/227 |
| 3,952,339 | 4/1976 | Baur et al. | 4/228 |
| 4,064,572 | 12/1977 | Wicks et al. | 4/228 |
| 4,171,546 | 10/1979 | Dirksing | 4/228 |
| 4,186,856 | 2/1980 | Dirksing | 4/228 |
| 4,208,747 | 6/1980 | Dirksing | 4/228 |
| 4,216,027 | 8/1980 | Wages | 4/228 X |
| 4,251,012 | 2/1981 | Owens et al. | 222/185 |
| 4,281,421 | 8/1981 | Nyquist et al. | 4/228 |
| 4,305,162 | 12/1981 | Cornelisse, Jr. et al. | 4/228 |

*Primary Examiner*—Henry K. Artis

*Attorney, Agent, or Firm*—Charles J. Zeller; George A. Mentis

[57] ABSTRACT

The present invention provides a passive dispenser for use in a toilet tank in which the solution to be dispensed is isolated from the water in the toilet tank, the dispenser comprising a product chamber having a venting means and a refill/discharge pathway which are held in fluid communication by an inclined conduit. Hydrostatic head obtained by use of the venting conduit in conjunction with the inclined conduit is utilized to prevent the solution from flowing out of the product chamber during quiescent periods. Constriction means in the venting conduit are preferred to modify equilibrium hydraulic forces during the flush/refill cycles.

11 Claims, 8 Drawing Figures

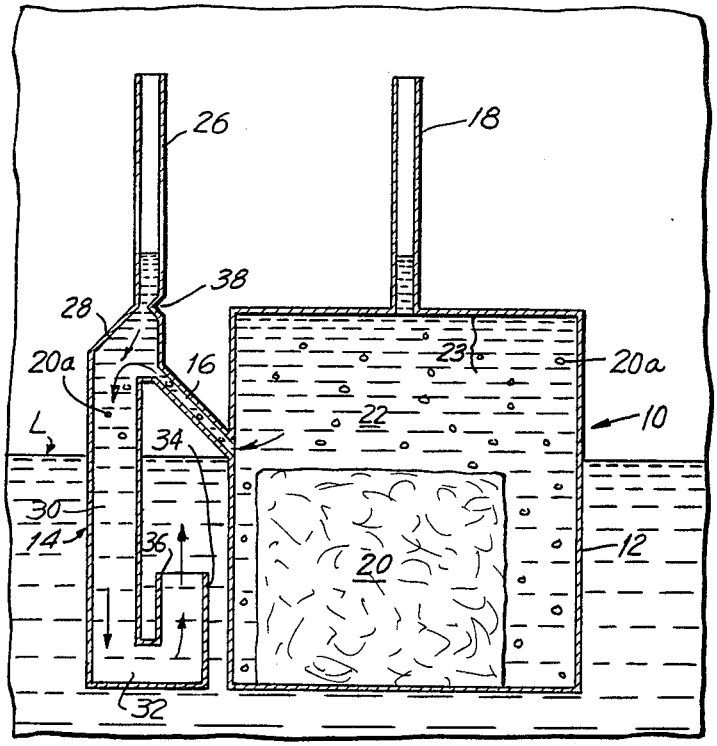
FIG. 3
FIG. 4
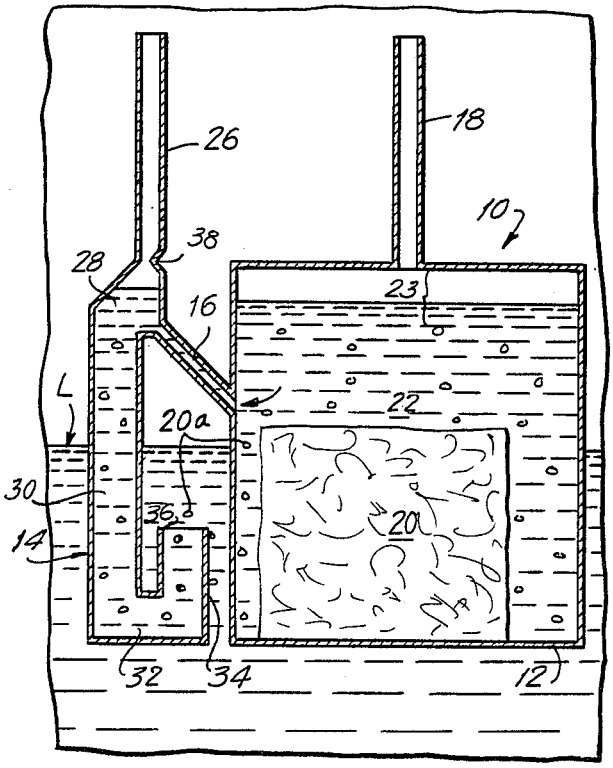
FIG. 5
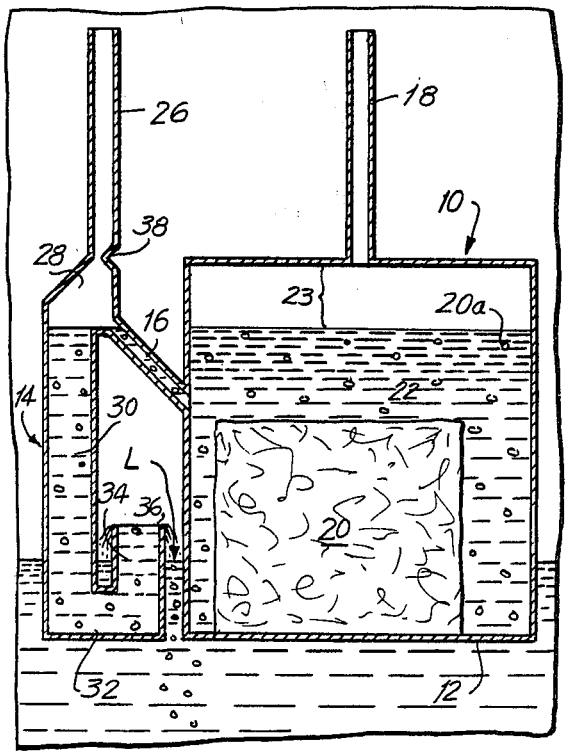

PASSIVE DISPENSER HAVING A DOUBLE AIR VENT SYSTEM

BACKGROUND OF THE INVENTION

1. Field of the Invention

This invention relates to a passive (i.e., no moving parts) dispenser for storing and issuing a predetermined amount of a solution into a toilet tank. More particularly, the present invention relates to a passive dispenser having a double air vent system and in which the solution to be dispensed is substantially isolated from the tank water by means of a hydrostatic pressure gradient directed towards the solution.

2. Description of the Prior Art

Devices for dispensing a disinfectant solution into a toilet tank for flow into the toilet bowl when the toilet tank is flushed are known. It is generally desirable to isolate the disinfectant from the water in the toilet tank during quiescent periods. It is known to use valves or other mechanisms which will shut off flow from the dispenser when the toilet tank is filled to a desired level. See, for example, U.S. Pat. Nos. 1,307,535; 2,682,165; 3,073,488; 3,341,074; 3,698,021; 3,778,849; 3,784,058; 3,895,739; and 4,036,407.

Passive dispensers which are devices having no moving parts are also known. In one type of such passive dispensers, the dispensers are alternately flooded and then siphoned when the tank is flushed. See, for example, U.S. Pat. Nos. 650,161; 1,144,525; 1,175,032; 1,213,978; and 3,339,801. In another type, the dispensers are alternately flooded and then drained gravitationally. See, for instance, U.S. Pat. Nos. 1,987,689; 3,121,236; 3,504,384; 3,545,014; 3,618,143; 3,604,020; 3,772,715; 3,781,926; 3,943,582; and 4,244,062. In addition, U.S. Pat. Nos. 2,688,754; 3,864,763; and 3,965,497 and U.K. Pat. No. 705,904 disclose toilet chemical dispensers in which a small amount of the chemical is released into the tank in the absence of hydrostatic pressure on the spout thereof, e.g. when the toilet has been flushed and the water level in the tank has dropped. As the tank becomes filled with water, the resulting hydrostatic head prevents the solution from being released from the dispenser. In a further type of passive dispenser, the solution to be dispensed is connected to a pressurized water supply such as the trap refill pipe in a toilet tank. See, for example, U.S. Pat. Nos. 3,407,412 and 3,444,566 wherein the direction of flow alternates in labyrinth passages. In all of the above mentioned passive dispensers, due to the construction thereof, the disinfectant can flow or diffuse into the toilet tank water.

Passive dispensers using air locks, i.e. pockets of air, to isolate the disinfectant from the water during quiescent periods in a toilet tank have been disclosed. For instance, U.S. Pat. Nos. 4,171,546 and 4,216,027 disclose passive dispensers which issue a predetermined volume of a toilet tank additive solution into a toilet tank as the water is draining therefrom when the toilet is flushed. According to these patents, an amount of a concentrated additive solution is drawn from a storage place into the tank as the water level therein drops resulting from flushing. The devices are provided with numerous baffles and passageways to form air locks which isolate the concentrated disinfectant solution from the tank water when the toilet tank is in a quiescent state. In these devices, the air locks are located at the top of the device. U.S. Pat. No. 4,186,856 discloses a passive dispenser having air locks formed in the top portion thereof when submerged to isolate the tank water from the concentrated disinfectant stored therein. Other passive dispensers are disclosed in U.S. Pat. Nos. 4,208,747, 4,305,162 and 4,307,474 wherein air locks are also employed to isolate the disinfectant from tank water during quiescent periods. However, the air locks in these patents are disposed at different levels whereas those employed in U.S. Pat. Nos. 4,171,546; 4,186,856 and 4,216,027 are at the same level and in the top portion thereof. U.S. Pat. No. 4,251,012 discloses another passive dispenser in which a concentrated disinfectant is issued into a toilet tank in measured quantities. Although air locks are also used to isolate the disinfectant from the tank water, this device is so constructed that the disinfectant is stored in a compartment which is not accessible to the tank water, even when the device is completely submerged. The air locks provided are located at the same level near the top portion thereof. U.S. Pat. No. 4,281,421 discloses a dispenser having separate compartments for storing individual components for toilet tank additives.

None of the above mentioned patents discloses or suggests a passive dispenser wherein the solution to be dispensed is substantially isolated from the water in the toilet tank by means of a hydrostatic head gradient which is directed toward the solution. In addition, none of the above mentioned patents teaches or suggests a dispenser having a double air vent system, one of the vents provided with a constriction to modify equilibrium hydraulic head forces during the flush/refill cycle.

SUMMARY OF THE INVENTION

This invention provides a passive (i.e. no moving parts) dispenser for containing a quantity of a solution in substantial isolation from a body of liquid in which the dispenser is immersed, and for dispensing a predetermined volume of the solution therefrom in response to a decrease in the level of the body of liquid from a first (higher) elevation to a second (lower) elevation. The dispenser comprises a product chamber having an air venting means; a refill/discharge pathway comprising a main compartment having an upwardly extending exit-/inlet port disposed at the bottom portion thereof and a venting conduit connected to the upper portion of the main compartment, and an inclined conduit connecting the refill/discharge pathway to the product chamber. The end of the inclined conduit connected to the refill-/discharge pathway is at an elevation that is higher than the opposite end of the inclined conduit, which end is connected to the product chamber. In the preferred embodiment the venting conduit is provided with constriction means positioned proximate the upper portion of the main compartment at a level higher than the upper end of the inclined conduit, but lower than the first elevation liquid level. The hydrostatic head in the inclined conduit effectively essentially prevents the solution stored in and to be dispensed from the product chamber from flowing or diffusing into the body of liquid when same is in a quiescent state.

BRIEF DESCRIPTION OF THE DRAWINGS

FIGS. 2–7 are simplified cross-sectional views which show a discharge and refill cycle of the dispenser of FIG. 1.

DETAILED DESCRIPTION OF THE INVENTION

According to the present invention, there is provided a passive dispenser for use in a toilet tank or the like whereby an additive composition, e.g., disinfectant, detergent, and the like, can be isolated from the water in a toilet tank during quiescent periods, i.e., between flushes. As a result of the particular construction of the present dispenser, there is provided a positive pressure gradient directed toward the product chamber in which the solution is stored so that the solution is substantially prevented from flowing or diffusing into the tank when same is in a quiescent state.

Figure 1:
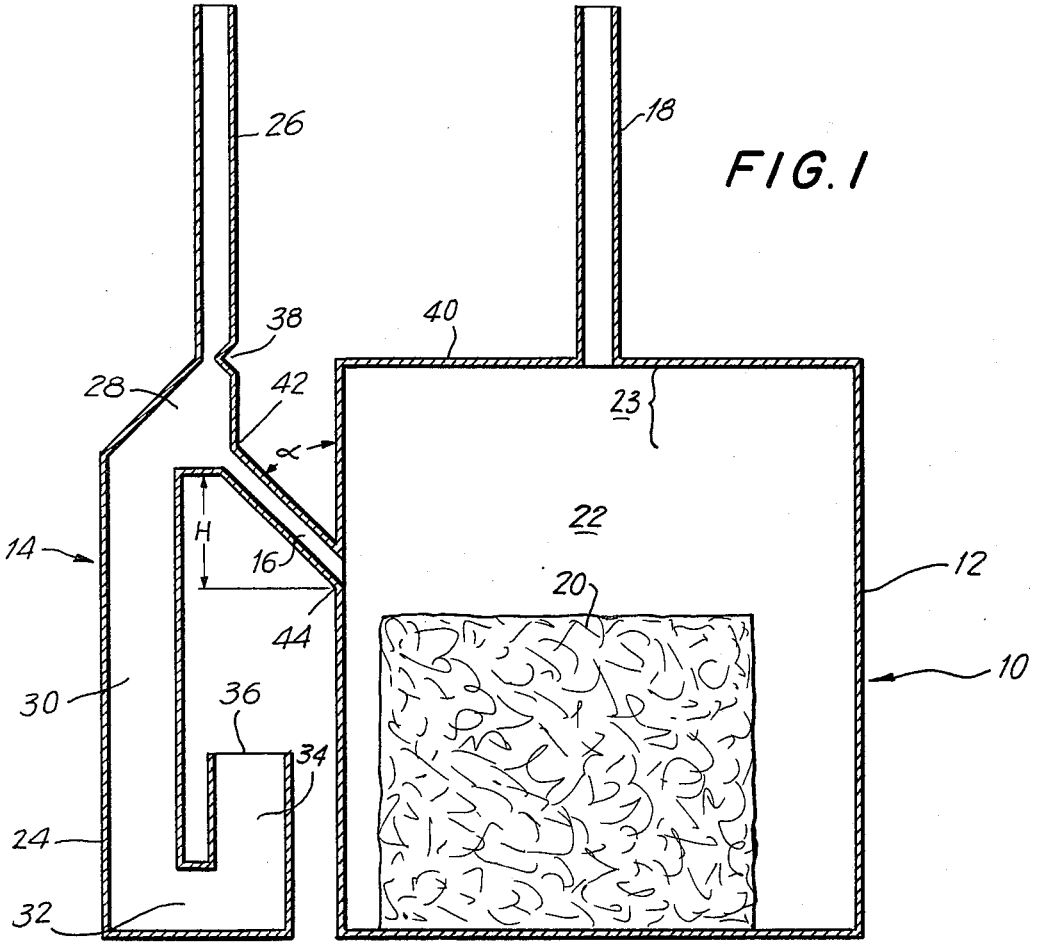
FIG. 1 shows a cross-sectional view of the preferred embodiment of the present dispenser.

With reference to the drawings, FIG. 1 shows a cross-sectional view of the present dispenser, designated generally by numeral 10. The dispenser comprises a product chamber 12 and a refill/discharge pathway 14 held in fluid communication by inclined conduit 16. Product chamber 12 is provided at the upper portion thereof with an air venting means 18 that vents the interior of product chamber 12 to the atmosphere. The length of air venting means 18 is such that it will permit the complete submersion of product chamber 12 in the toilet tank water.

Figure 2:
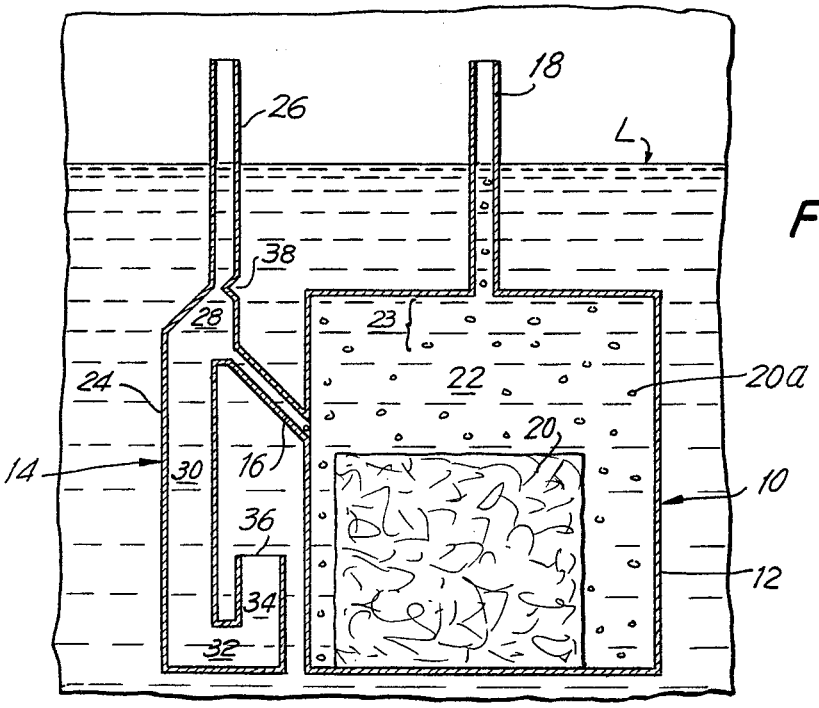

Material to be dispensed, represented by solid bar or cake 20, is stored within product chamber 12, the bar 20 having such dimensions that it does not occupy the entire interior space of the chamber 12. Accordingly, there exists in chamber 12 a volume 22, hereinafter referred to as a solution reservoir, into which water from the toilet tank (not shown) enters. Contact between the water and solid phases results in dissolution of the bar 20 to form product solution **20*a* (FIG. 2). As the bar 20 is dissolved, the volume of solution reservoir 22 increases. The material to be dispensed, for example, disinfectant, detergent and the like, may also exist in forms other than a bar, for example, as a gel or semi-solid, as a coating or impregnate with a suitable carrier, or as a pulverulent material within a water permeable membrane. A portion of the volume of bar 20** could comprise soluble/insoluble inerts. Two or more additives, each having the same function but with different solubility rates could be employed to extend the useful life of the dispenser. Similarly, time release could be achieved by encapsulating additives with inert materials of varying solubility.

The amount of solution **20*a* dispensed into the tank is equal to the volume of solution 20*a* in solution reservoir 22 above the upper end 42 of inclined conduit 16, which volume is hereinafter referred to as the product reservoir 23**. Solution concentration varies with time until equilibrium is attained. Because a residual volume of solution remains after a flush, the dispensing of at least a dilute solution is always assured as in the case of a second immediate use of the dispenser.

Refill/discharge pathway, generally designated as 14, comprises a main compartment 24 and venting conduit 26 connected to the top portion of main compartment 24. Main compartment 24 has the general configuration of the letter C comprising upper portion 28, substantially vertical central portion 30, bottom portion 32 and substantially vertical end portion 34, all portions 26, 28, 30, 32 and 34 being in fluid communication with one another. Although a C shaped main compartment is shown herein, compartments having other configurations such as curved upper and lower portions can also be used provided that the conditions described below are satisfied. Vertical end portion 34 is provided at its upper end with an exit/inlet port 36 through which the solution to be dispensed can flow into the tank in the flush cycle and water can flow into the dispenser in the refill cycle. Vertical end portion 34 is important in that it reduces seepage from the dispenser if the water level in the tank becomes sufficiently low without flushing to force the product solution in product chamber 12 to flow into vertical central portion 30 of main compartment 24. In addition, solid particles which may be expelled from product chamber 12 are caught in vertical end portion 34 and prevented from entering the toilet tank.

Upper portion 28 is connected to venting conduit 26 and to inclined conduit 16. In the preferred embodiment as shown in FIG. 1, the lower portion of venting conduit 26 is provided with a constriction 38, the function of which will be explained hereinbelow. Constriction 38, preferably located in vent 26, should be at an elevation which is no lower than the upper end 42 of conduit 16. Product chamber 12 and refill/discharge pathway 14 are connected by inclined conduit 16, upper end 42 of conduit 16 being connected to portion 28 of main chamber 24, the lower end 44 of conduit 16 being connected to product chamber 12.

The height H of the inclined conduit 16 should be such as to essentially isolate solution **20*a* in solution reservoir 22 from the tank during quiescent periods. The greater the height H, the greater the hydrostatic pressure gradient directed toward product chamber 12, the effect of which is to minimize diffusion of solution 20*a* into main compartment 24 and ultimately into the tank itself. The height H is limited in its upper range by constraints on practical dispenser dimensions, while the lower limit of H is about $\frac{1}{4}$ inch. Preferably, the height H is between $\frac{1}{2}$ and two inches, which provides a hydrostatic head sufficient to substantially prevent diffusion of the solution. The angle $\alpha$ which inclined conduit 16 makes with the vertical axis of the product chamber 12 is critical only insofar as compact design of the dispenser limits the horizontal distance between the pathway 14 and the chamber 12. For reasonably compact designs with values of H below 2 inches, the angle $\alpha$ is between about 10° to about** 80°, preferably between 10° to 60°.

Venting conduit 26 and venting means 18 are shown in FIG. 1 to have the same height for simple manufacture. Both vents 18 and 26 have sufficient length to extend into the atmosphere when product chamber 12 and refill/discharge pathway 14 are completely immersed in the toilet tank water.

The operation of the present dispenser is shown sequentially in FIGS. 2 to 7. In FIG. 2, the toilet tank (not shown) is full of water, representing a between flushes situation, i.e., the toilet tank is in a quiescent state. The product solution **20*a* resulting from contact between water and soluble solid bar 20 is confined within storage chamber 12, venting means 18, and the lower end of inclined conduit 16. Refill/discharge pathway 14, the remainder of inclined conduit 16, and venting conduit 26 are filled with essentially solute free tank water from the toilet tank up to water level L. A very dilute solution may be present in pathway 14 as a result of an incomplete return during the filling cycle of the residual amount of product solution remaining in portion 32** following a flush, or as a result of diffusion of solution 20*a* into the pathway 14 during an extended quiescent period.

FIG. 3 shows the first stage of the flush cycle. When the toilet tank is flushed, the water level L drops rapidly as compared to the liquid level in the dispenser 10. As the difference between these relative levels increases, the hydraulic head pressure of liquid within the dispenser 10 increases, resulting in flow of solution 20*a* from the dispenser to the tank through refill/discharge pathway 14 and exit/inlet port 36. As the level L continues to fall, and as a consequence of a resultant increase in the hydraulic head pressure between the solution 20*a* level in the chamber 12 and the tank liquid level, the flow rate from the dispenser increases. In FIG. 4 the height of liquid in chamber 12 is still within the confines of the product reservoir 23, and solution 20*a* continues to be dispensed from chamber 12, the top portion of said chamber now having a blanket of air therein, the air entering through vent 18.

Figure 6:
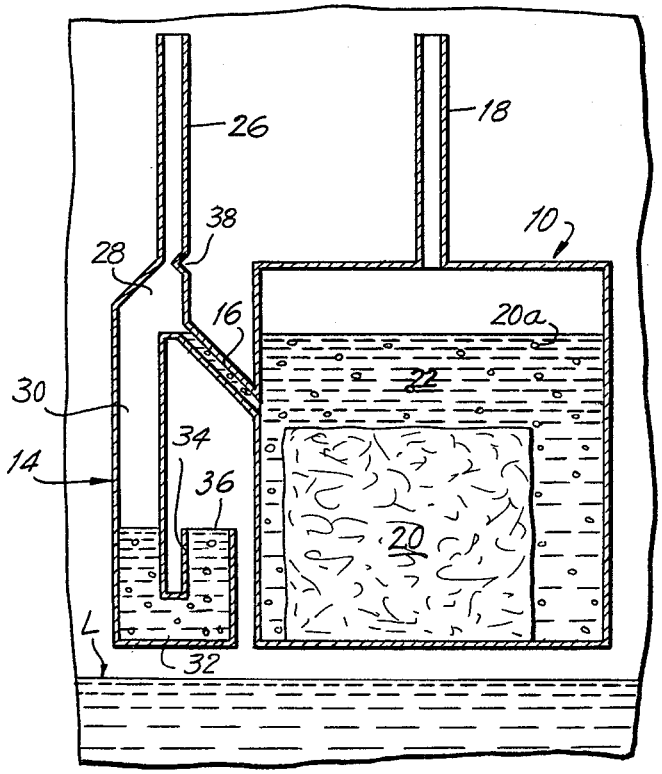

In FIG. 5, the solution in product reservoir 23 has been dispensed, the solution in pathway 14 continuing to flow to the tank. FIG. 6 illustrates the end of the flush cycle, a predetermined amount of the solution having been dispensed into the toilet tank with ultimate release into the toilet bowl. The level of solution in chamber 12 is at the same elevation as the upper end 42 of conduit 16, and the volume of solution dispensed is equal to the volume of the product reservoir 23. The volume of solution remaining in chamber 12 is thus equal to the volume of the solution reservoir 22 less the volume of the product reservoir 23.

Figure 7:
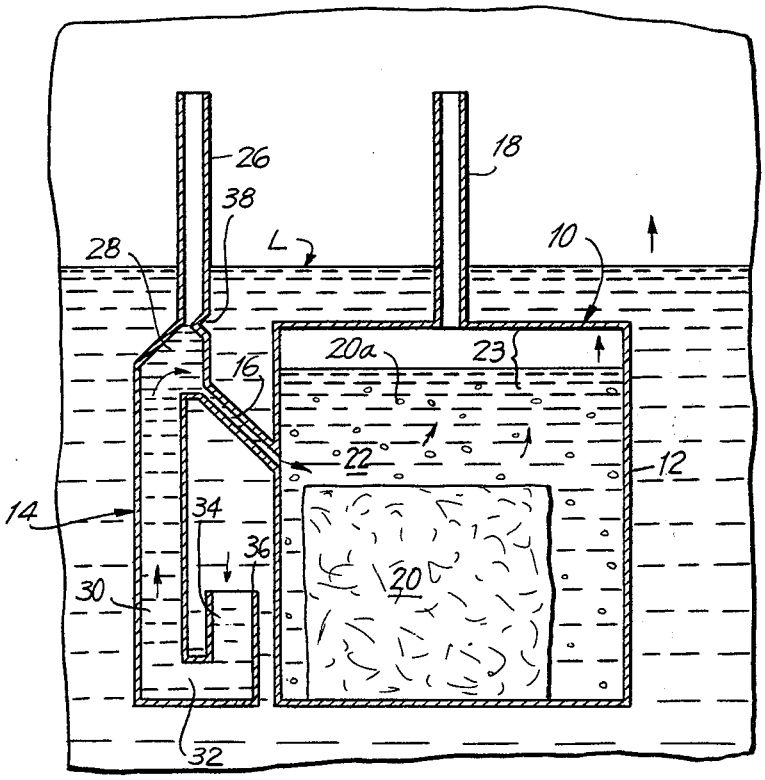

FIG. 7 illustrates an intermediate stage in the refill cycle. As the water level L rises, fresh water enters refill/discharge pathway 14 through exit/inlet port 36 and into chamber 12. Refill/discharge pathway 14 fills rapidly thereby flooding portion 28. The positive hydraulic head pressure thus obtained in pathway 14 against constriction 38 provides a significant pressure driving force toward the product chamber 12 through conduit 16, said conduit acting as a nozzle. The jet of liquid from conduit 16 preferably impinges upon the solid bar 20 or other material thereby enhancing dissolution of the solute and the rapid formation of the product solution 20*a*. Not only is a more uniform solution formed within chamber 12, but the solution formed is ready for use soon after the tank is filled as in the case of repeated flushing.

The utilization of the constriction 38 is not a necessary feature of the invention. Its inclusion is preferred in that it provides the jetting action described in the previous paragraph during the filling of the dispenser. To obtain the jetting action, the cross-sectional area of the constriction 38 should be smaller than the cross-sectional area of the inclined conduit 16. The higher pressure drop across the constriction establishes a preferential flow path, accompanied with higher flow velocities, through the conduit 16. Typically, a ratio of constriction cross-sectional area to venting conduit 26 cross-sectional area in the range of from about 0.01 to about 0.5 is satisfactory to obtain the requisite back pressure. For the same reason, and as part of the preferred embodiment, the components of the refill/discharge pathway 14—the upper portion 28, the central portion 30, the bottom portion 32, and the end portion 34—should each have cross-sectional areas larger than that of the inclined conduit 16. In the most preferred embodiment of the dispenser 10, the cross-sectional area of each component decreases with respect to the preceding component starting from the end portion 34 and ending with the upper portion 28, all of which are greater than the cross-sectional area of inclined conduit 16. The area of constriction 38 is less than that of conduit 16. The individual components may have cross sections of constant area, or the entire pathway can be arcuate in design with interior walls diverging towards the conduit 16.

In its broadest aspect, the dimensional limitations described above are not critical, the vent 26 being an elongate tube whose diameter is preferably smaller than the diameter of the inclined conduit 16. Even this limitation is unnecessary to obtain a functionally operable dispenser of the present invention, which requires only that the dispenser be placed in the body of liquid as to allow vents 18 and 26 to extend above the tank high liquid level.

If used, the constriction can assume a variety of configurations, for example, the modified venturi shape as shown in FIG. 1, a standard square edged orifice, a standard venturi, or the like. It would also be possible to place constriction 38 in portion 28, provided the pressure drop thereacross was sufficient to provide the jetting action. Constriction 38 or the start of vent 26 as the case may be must be disposed at an elevation equal to or above the upper end of inclined conduit 16.

Figure 8:
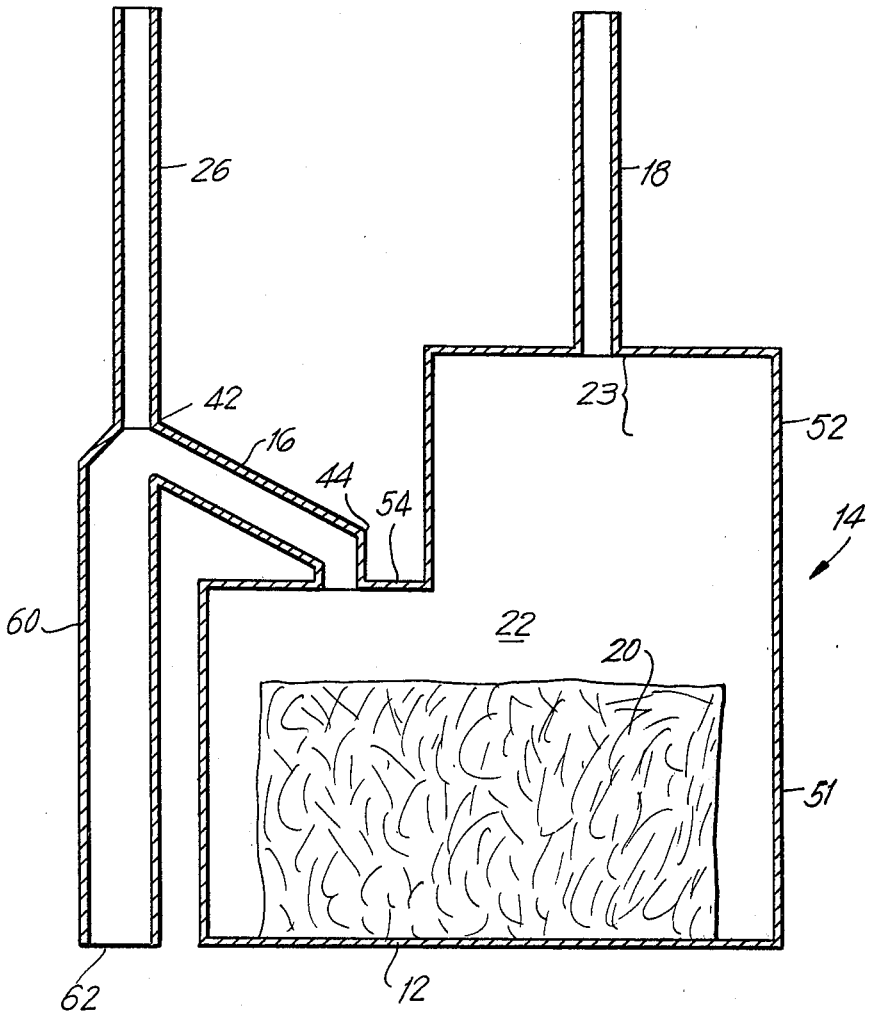
FIG. 8 is an alternate embodiment of the present invention, which embodiment is also illustrative of several of the broader aspects of the invention.

FIG. 8 is an alternate embodiment of the present invention, which embodiment is also illustrative of several of the broader aspects of the invention as mentioned above. In FIG. 8 the product chamber 12 comprises a lower portion 51 and an upper portion 52, the upper portion 52 being of smaller width than portion 51 thereby forming a shoulder 54 at the top of the portion 51. Venting means 18 extends from the top of portion 52 to the atmosphere. The refill/discharge pathway comprises a vertical cylindrical member 60 with an inlet-/exit port 62 at the bottom thereof. Venting conduit 26 extends from the top of member 60 to the atmosphere, the constriction being omitted therefrom. Inclined conduit 16 is connected at its upper end 42 to the top side wall of member 60, and at its lower end 44 to the shoulder 54 of chamber 12. The cross-sectional area of vent 26 is much smaller than the cross-sectional area of conduit 16, thereby achieving a jetting action during refill. The lower end 44 of conduit 16 is oriented for nearly vertical discharge into chamber 12 so that the incoming liquid impinges on solid cake 20. As before, the product reservoir 23 is that volume of chamber 12 (now in portion 52) above the upper end 42 of inclined conduit 16, while the solution reservoir 22 is the volume of chamber 12 less the volume of cake 20.

The present dispenser can be made of any suitable material. Examples of useful materials include thermoformed or molded polyvinylchloride, acrylonitrile-butadiene-styrene copolymer, polyethylene and similar resins. Compositions of the dispensed material may comprise a disinfectant, a deodorant, a bleaching agent, a detergent and mixtures thereof. Other ingredients such as fillers, thickeners, fragrances and coloring agents may also be incorporated. Such additive compositions are well known in the art.

What is claimed is:

1. A passive dosage dispenser for containing a quantity of a solution isolated from a body of liquid in which said dispenser is immersed and for causing a predetermined volume of said solution to issue from said dispenser in response to the level of said body of liquid being lowered from a first elevation to a second elevation, the dispenser comprising a product chamber having an air venting means, a refill/discharge pathway having an exit/inlet port at the bottom portion thereof, a venting conduit connected to the top of said pathway, and an inclined conduit having a first end and a second end, the first end being connected to said refill/discharge pathway and the second end being connected to said product chamber, said first end being disposed at a higher elevation than said second end.

2. The dispenser of claim 1 wherein the cross-sectional area of the venting conduit is smaller than the cross-sectional area of the inclined conduit.

3. The dispenser of claim 2 wherein the cross-sectional area of the refill/discharge pathway is larger than the cross-sectional area of the inclined conduit.

4. The dispenser of claim 1 wherein said refill/discharge pathway comprises a main compartment having an upper portion, a vertical central portion, a bottom portion and a vertical end portion, said portions being in fluid communication with one another, the upper portion being connected to the venting conduit and the inclined conduit, the exit/inlet port being disposed at the upper end of said vertical end portion.

5. The dispenser of claim 4 wherein the venting conduit is provided with constriction means, the ratio of the cross-sectional area of the constriction to that of the venting conduit being sufficient to create a back pressure that directs flow through the inclined conduit to the product chamber.

6. The dispenser of claim 5 wherein said constriction means is positioned in said venting conduit proximate the upper portion of said main compartment at a level above the first end of the inclined conduit, but below the first liquid elevation, the cross-sectional area of the constriction being smaller than the cross-sectional area of the inclined conduit.

7. The dispenser of claim 6 wherein the ratio of the cross-sectional area of said constriction to said venting conduit is from about 0.01 to about 0.50.

8. The dispenser of claim 6 wherein the cross-sectional areas of the portions of the main compartment decrease in the direction of flow into the dispenser, the cross-sectional area of he inclined conduit being smaller than that of the upper portion of said main compartment.

9. The dispenser of claim 1 or 6 wherein the first end of said inclined conduit is at least $\frac{1}{4}$ inch above the second end thereof, said conduit forming an angle of from about 10° to about 80° with respect to the vertical axis.

10. The dispenser of claim 9 wherein the first end of said inclined conduit is less than about two inches above the second end thereof.

11. The dispenser of claim 10 wherein the inclined conduit forms an angle of from about 10° to about 60° with respect to the vertical axis.

* * * * *